US011091941B2

(12) United States Patent
Miller

(10) Patent No.: US 11,091,941 B2
(45) Date of Patent: Aug. 17, 2021

(54) LARGE BOLLARD POST DOORS

(71) Applicant: Peter Miller, Wauconda, IL (US)

(72) Inventor: Peter Miller, Wauconda, IL (US)

( * ) Notice: Subject to any disclaimer, the term of this patent is extended or adjusted under 35 U.S.C. 154(b) by 33 days.

(21) Appl. No.: 15/928,095

(22) Filed: Mar. 22, 2018

(65) Prior Publication Data

US 2019/0292826 A1 Sep. 26, 2019

(51) Int. Cl.

| | |
|---|---|
| ***E05D 7/06*** | (2006.01) |
| ***E05D 11/04*** | (2006.01) |
| ***E05D 15/48*** | (2006.01) |

(52) U.S. Cl.

CPC ..... *E05D 7/06* (2013.01); *E05D 11/04* (2013.01); *E05D 15/48* (2013.01); *E05D 2015/487* (2013.01); *E05Y 2900/60* (2013.01)

(58) Field of Classification Search

CPC ..... E05D 7/06; E05D 11/04; E05D 2011/045; E05D 15/48; E05D 2015/487; E05F 1/061; E05F 1/068; E05F 13/06; E04H 2017/1473; E04H 2017/1491; E06B 11/04

USPC ..... 49/236, 398

See application file for complete search history.

(56) References Cited

U.S. PATENT DOCUMENTS

| | | | | |
|---|---|---|---|---|
| 363,964 | A * | 5/1887 | Philpott | E06B 11/08 49/46 |
| 610,820 | A * | 9/1898 | Nehr | E05D 11/04 16/276 |
| 1,540,490 | A * | 6/1925 | Mertel | E06B 11/04 49/381 |
| 4,945,606 | A * | 8/1990 | Eckel | E05F 1/065 16/250 |
| 7,958,675 | B2 * | 6/2011 | Stull | E06B 11/02 256/73 |
| 2002/0116788 | A1 * | 8/2002 | Pompei | E05F 1/063 16/315 |
| 2008/0237561 | A1 * | 10/2008 | Cozby | E04H 17/1413 256/73 |
| 2014/0283337 | A1 * | 9/2014 | Triebold | E05D 7/00 16/224 |
| 2015/0191955 | A1 * | 7/2015 | Dudley | E05F 3/08 49/333 |
| 2017/0074015 | A1 * | 3/2017 | Batchelor | E05D 7/12 |

FOREIGN PATENT DOCUMENTS

| | | | | |
|---|---|---|---|---|
| DE | 577307 C | * | 5/1933 | E05F 1/061 |
| FR | 2977615 A3 | * | 1/2013 | E04H 17/1404 |
| GB | 746075 A | * | 3/1956 | E06B 11/04 |

* cited by examiner

*Primary Examiner* — Christine T Cajilig
(74) *Attorney, Agent, or Firm* — AddyHart P.C.; Gregory B. Gulliver

(57) ABSTRACT

A bollard that supports a door with a top bearing, middle bearing and bottom bearing with the middle and bottom bearing offset from the bollard.

8 Claims, 6 Drawing Sheets

LARGE BOLLARD POST DOORS

BACKGROUND OF THE INVENTION

1. Field of the Invention

This invention relates generally to bollard mounted doors, and more particularly to large external bollard mounted doors.

3. Related Art

In use today are large doors or gates that are mounted on bollards, or in simple terms posts. For small doors, the strength of the post and mounting are typically sufficient to maintain the door in a level position over time. But with large doors, a problem exists with the doors sagging due to the weight of the door. The sagging doors result in premature door failure or bollard failure. Further, bollard failure also occurs due to weathering of the exposed bollard (rust, wear, and abuse).

There have been attempts to correct these problems, such as adding supports to the bottom of doors or even wheels. The problem with such approaches is an increase in materials, expense, and points of failures occur. Such approaches also do nothing to protect the bollard from the elements.

Therefore, there is a need for methods and systems for maintaining the operational state of a large bollard door while protecting the bollard.

SUMMARY

Systems and methods consistent with the present invention provide an approach for fabricating and installing large bollard doors and their associated bollard such that the door's position moves in the vertical plain in addition to the horizontal plain as the door is opened and closed. Further, the door protects the bollard from the environment by covering most of the bollard while being able to rotate on the bollard with maintenance free bearings.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. In the figures, like reference numerals designate corresponding parts throughout the different views.

DETAILED DESCRIPTION

A bollard door support is described with multiple bearings that assist with preventing the door or gate from sagging while protecting the top of the bollard.

Figure 1:
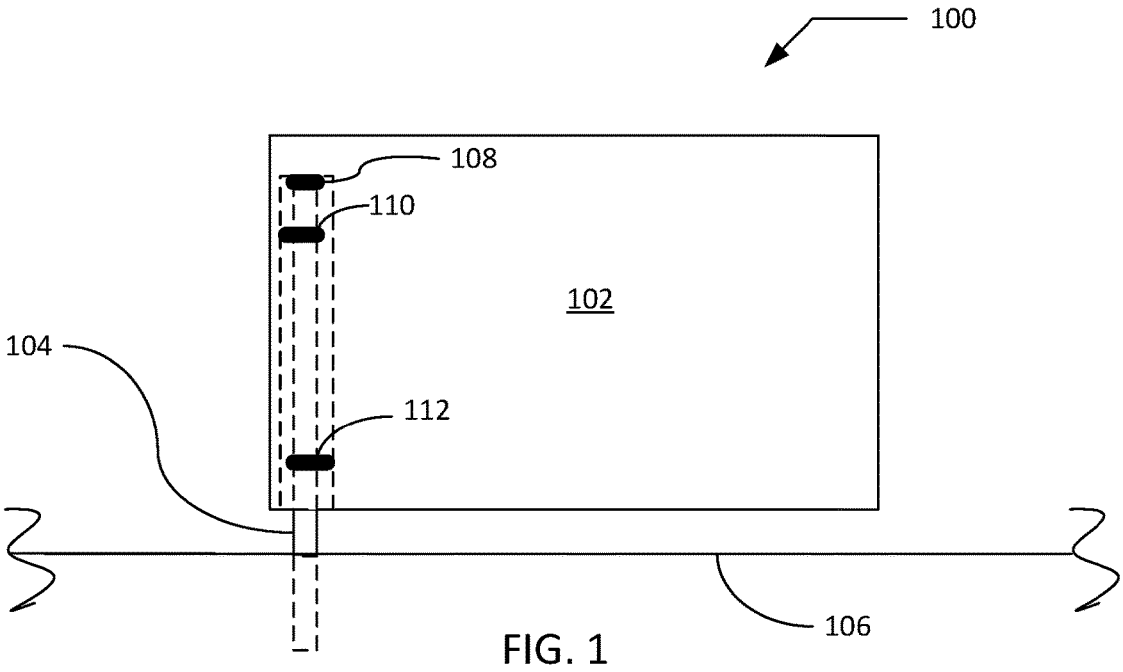
FIG. 1 illustrates a bollard and door in accordance with an example implementation of the invention.

Turning first to FIG. 1, an illustration 100 a bollard 104 and door (or gate) 102 is depicted in accordance with an example implementation of the invention. The bollard 104 may be hollow, hollow with fill, or made up of sections. The bollard 104 must be strong enough to support the door 102 without moving. The bollard 104 support may come from embedding part of the bollard 104 in the ground 106, such as a hole formed from concrete. In other implementations, brackets secured to the ground or combination of bracket and hole may be used to support the bollard 104. The bollard 104 may support or have a plurality of bearings (108, 110 and 112) or devices that allow the door 102 to swing or otherwise move when the door 102 is placed over the bollard 104.

Figure 2:
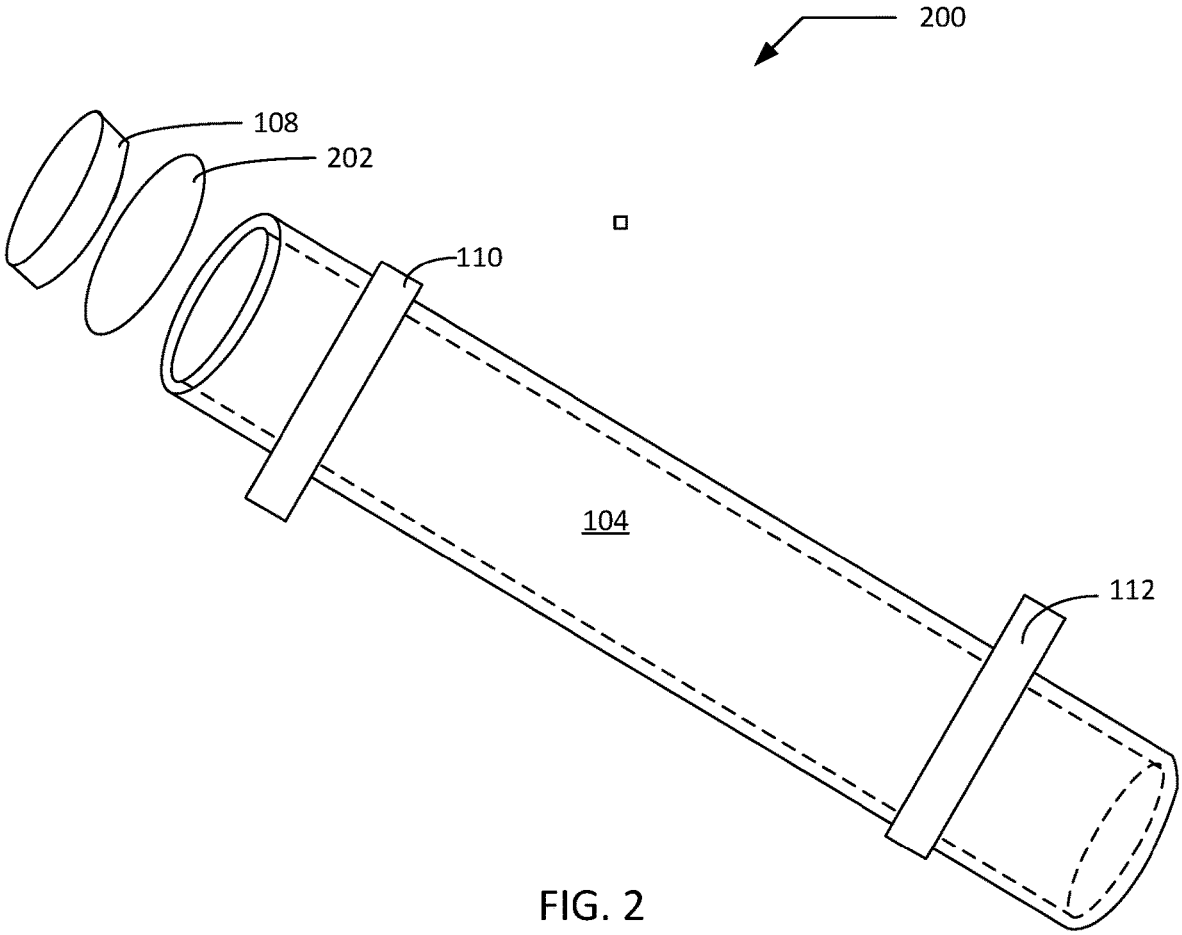
FIG. 2 illustrates the components of the bollard of FIG. 1 in accordance with an example implementation of the invention.

In FIG. 2, the components 200 of the bollard 104 of FIG. 1 are illustrated in accordance with an example implementation of the invention. The bollard 104 is shown with a top 202. The bollard 104 is typically made out of steel as it is stronger and holds up to the elements better than iron. But, in other implementations other materials such as, for example composite material or aluminum may be employed. A top bearing 108 is set on the top 202 and supports the movement of the door (102 of FIG. 1). An example of bearing beyond the traditional roller bearing, includes a disc (may be of other shape) that has a low coefficient of friction that enables the door 102 to turn on the top bearing 108. An example of such material is phelonic plastic manufactured by GENERAL ELECTRIC (GE). The bearing rings 110 and 112 are made of similar low friction material and may be supported or attached to the bollard 104. The ring bearing 110 and 112 then support or help support the door 102.

Figure 3:
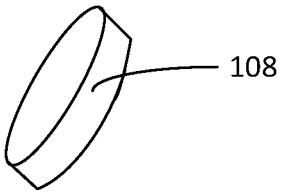
FIG. 3 illustrates a top bearing of the bollard of FIG. 2 in accordance with an example implementation of the invention.

Turning to FIG. 3, a top bearing 108 of the bollard 104 of FIG. 2 is illustrated in accordance with an example implementation of the invention. The top bearing is smaller in diameter or width than the bollard 104. Since it is made out of substance with a low coefficient of friction the door 102 resting with at least part of its weight on bearing 108.

Figure 4:
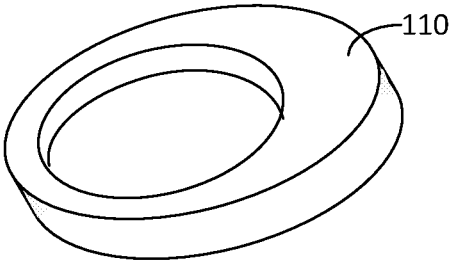
FIG. 4 illustrates a middle bearing of the bollard of FIG. 2 in accordance with an example implementation of the invention.

In FIG. 4, a middle bearing 110 of bollard 104 of FIG. 2 is illustrated in accordance with an example implementation of the invention. The middle bearing is not a perfect circle, rather it is elongated with a circular hole formed or cut off center. The material the middle bearing 110 is composed of is the same as the top bearing 108 of FIG. 3.

Figure 5:
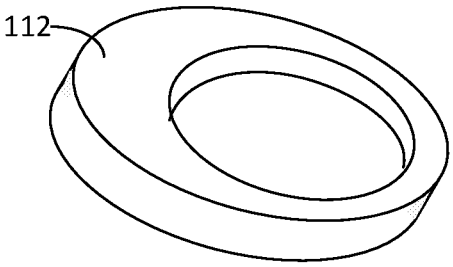
FIG. 5 illustrates a bottom bearing of the bollard of FIG. 2 in accordance with an example implementation of the invention.

Turning to FIG. 5, a bottom bearing 112 of bollard 104 of FIG. 2 is illustrated in accordance with an example implementation of the invention. The bottom bearing is not a perfect circle, rather it is elongated with a circular hole formed or cut off center. The material the middle bearing 110 is composed of is the same as the top bearing 108 of FIG. 3.

Referring back to FIG. 2, it is noted that the middle bearing 110 and bottom 112 bearing are positioned such that elongated portions of the bearings 110 and 112 oppose each other. When the door 102 is in a closed position, the door is actually angled in an upward angle and when opened up sweep in a downward motion due to the offset bearings 110 and 112. The advantage of such an arrangement is the sag that normally occurs with large bollard doors is negated by the door being angled in an upward angle.

Figure 6:
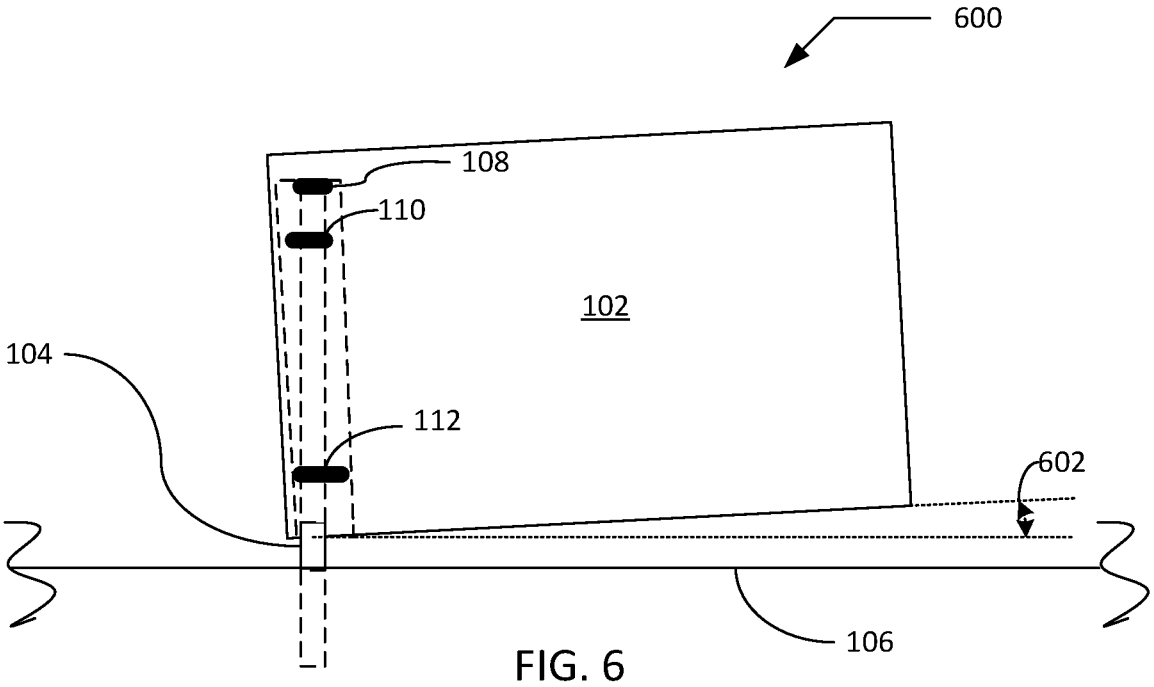
FIG. 6 illustrates the bollard and door of FIG. 1 in an open position in accordance with an example implementation.

In FIG. 6, the bollard 104 and door 102 of FIG. is illustrated 600 in an open position in accordance with an example implementation. When the door 102 is open, the offset holes in the upper bearing 110 and lower bearing 112 cause the door 102 to rise in the vertical plan 602 as it is turned. Such an arrangement of bearings prevents the door from dragging or sagging while swinging open and/or closed. Further, the door 102 is covering the majority of the bollard 104 and protecting it from the elements.

Figure 7:
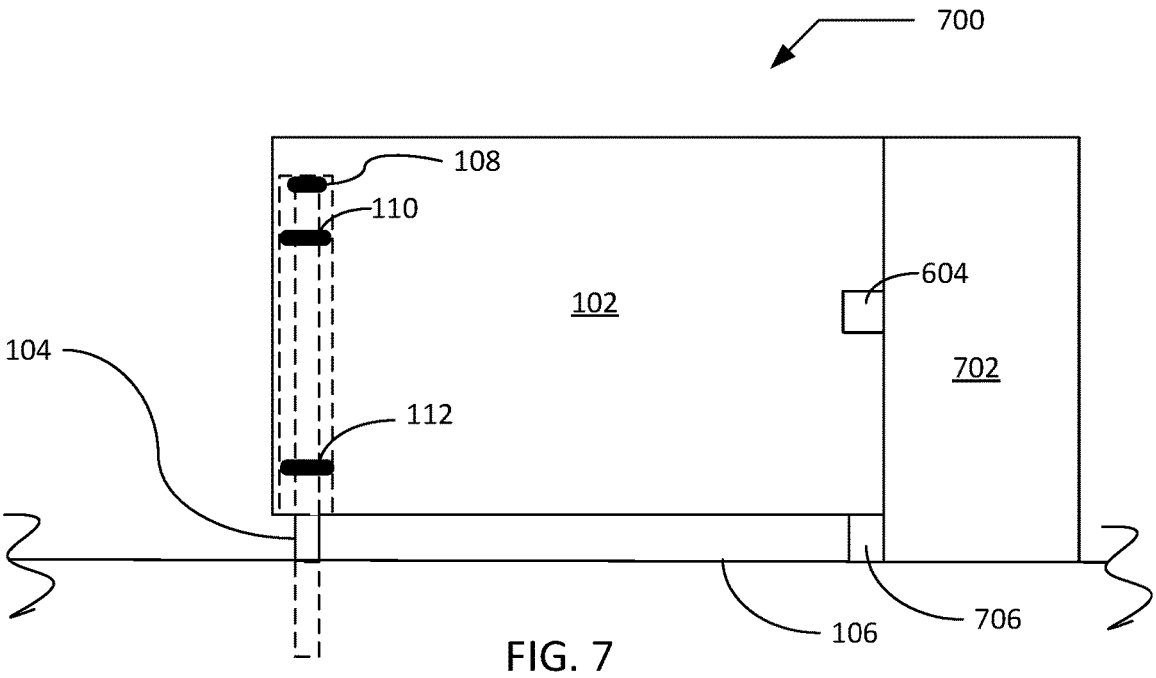
FIG. 7 illustrates the bollard and door of FIG. 1 in a closed position in accordance with an example implementation.

Turning to FIG. 7, the bollard 104 and door 102 of FIG. is depicted 700 in a closed position in accordance with an example implementation. The door 102 may have a latch 604 and door stop 706 that prevents the door from freely swinging around the bollard 104 in the current implementation. In other implementation, one or more doors may freely swing on the bollard 104 forming a turnstile. The door stop 706 may be attached to a wall or structure, such as wall 702.

Figure 8:
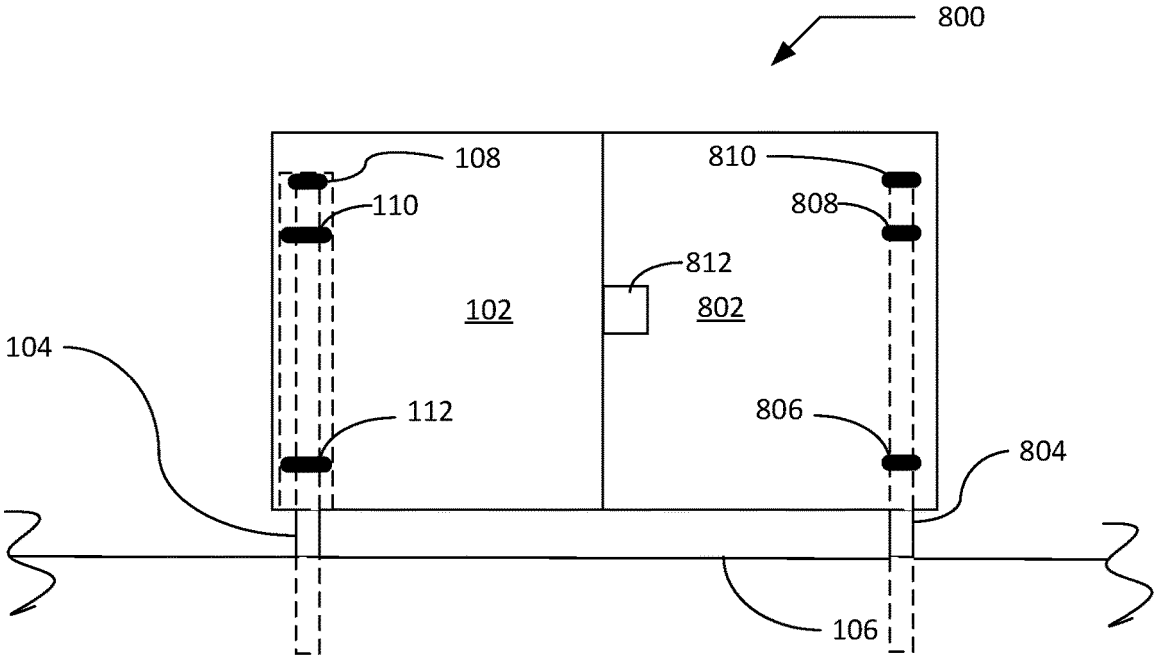
FIG. 8 illustrates the bollard and door of FIG. 1 with an additional door in accordance with an example implementation.

In FIG. 8, the bollard 104 and door 102 of FIG. 1 are illustrated 800 with an additional door 802 and additional bollard 804 in accordance with an example implementation. The bollard 804 has a top bearing 810, middle bearing 808 and bottom bearing 806. Bollard 804 is shown secured in the ground 106 in a similar manner to bollard 104. The doors may be shaped to form a seal or otherwise latch using latch 812.

Figure 9B:
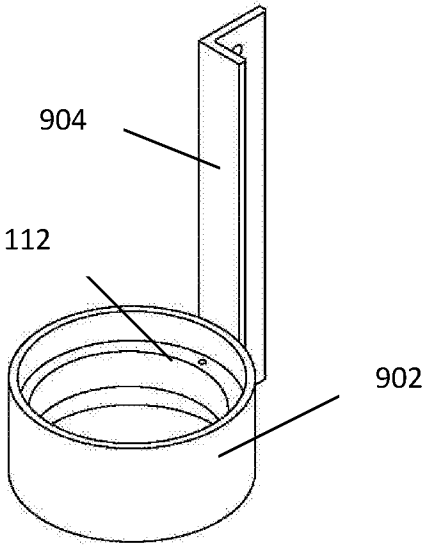
FIGS. 9*a-d* are illustrations a lower bracket having a lower bearing in accordance with another implementation of the invention.
Figure 9D:
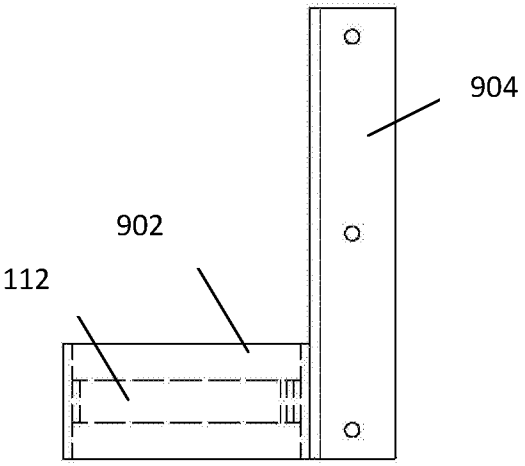
Figure 9A:
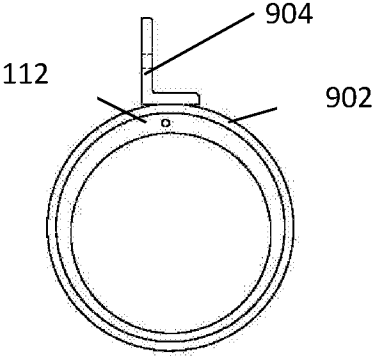
Figure 9C:
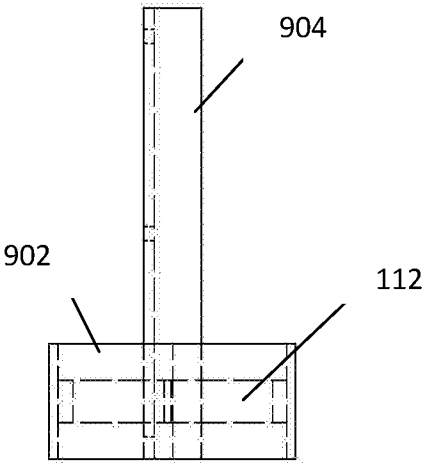
Figure 10A:
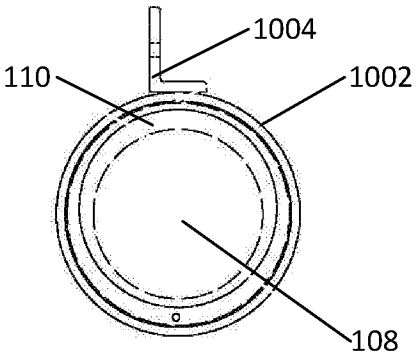
FIGS. 10*a-d* are illustrations of an upper bracket having a middle bearing and top bearing in accordance with another implementation of the invention.
Figure 10B:
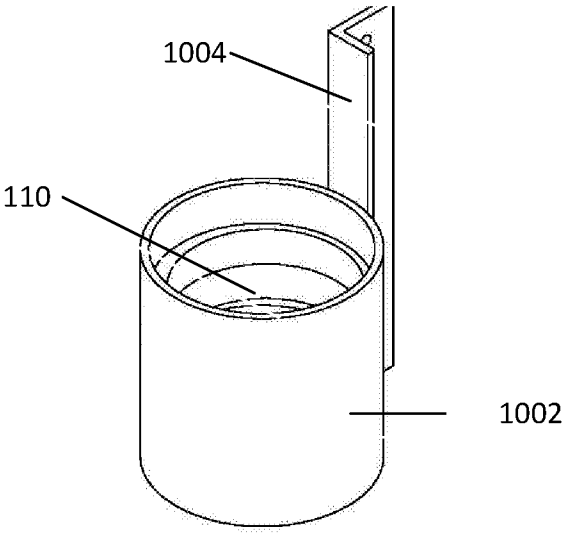
Figure 10C:
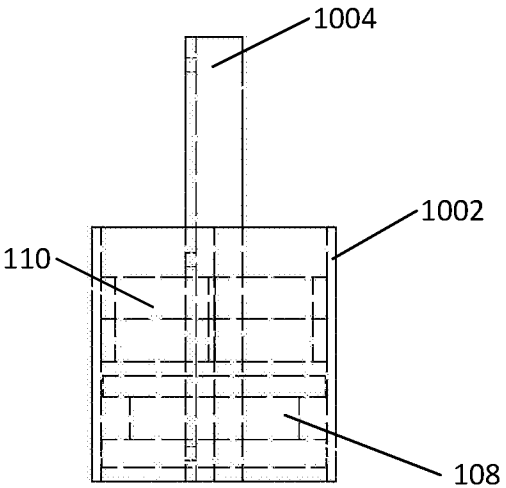
Figure 10D:
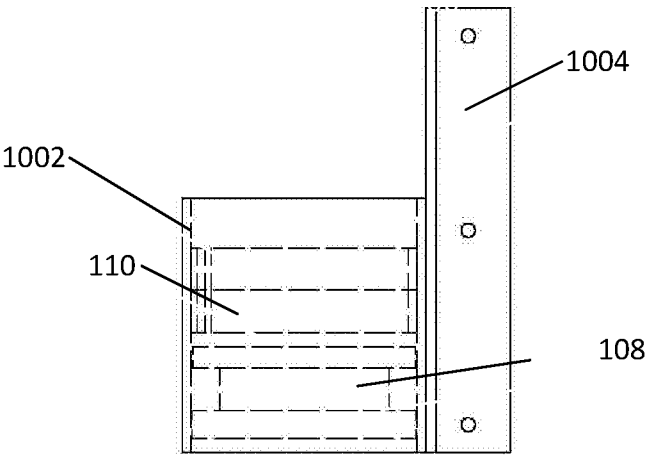

Turning to FIGS. 9*a-b*, a lower bracket 902 having the lower bearing 112 is illustrated in multiple views in accordance with another implementation of the invention. The lower bracket 902 has a securing portion 904 for securing the bracket 902 to a door, such as door 102. In the current example, the securing portion 904 is an angled piece of metal that is welded to the lower bracket 902. In other implementations, the securing portion 904 may be formed or molded with the lower bracket 902. The lower bracket 902 is formed such that lower bearing is secured in the lower bracket and slides over a bollard, such as bollard 104. The door is attached with fasteners to the securing portion 904 and the lower bracket 902 turns with the door.

In FIG. 10*a-d*, an upper bracket 1002 with a middle bearing 110 and a top bearing 108 is illustrated in multiple views in accordance with another implementation of the invention. The upper bracket 1002 has a securing portion 1004 for securing the upper bracket 1002 to a door, such as door 102. In the current example, the securing portion 1004 is an angled piece of metal that is welded to the upper bracket 1002. In other implementations, the securing portion 1004 may be formed or molded with the upper bracket 1002. The upper bracket 1002 is formed such that upper bearing 110 is secured in in the upper bracket and slides over a bollard, such as bollard 104. The upper bracket 1002 is sealed at one end and encloses the top bearing 108 on the side surface and one of the plainer surfaces. The other plainer surface of the top bearing 108 supports the upper bracket 1002 on the bollard 104. An advantage of the upper bracket 1002 is that it covers the top of the bollard and protects it from the elements. The door is attached with fasteners to the securing portion 1004 and the upper bracket 1002 turns with the door.

The foregoing description of an implementation has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A bollard door support that mounts on a bollard supporting a door, comprising: a first bracket having a lower bearing; a second bracket having an upper bearing, where the first bracket and second bracket are attached to the door with the first bracket and the second bracket slide over the bollard and the first bearing and second bearing are not aligned in a vertical plane that enables the first bracket and second bracket to rotate on the bollard to move the door and move in the vertical plane and a horizontal plane during rotation.

2. The bollard door support of claim 1, further comprising a top bearing located in the second bracket, where the top bearing is a solid bearing and supports the door and the first bracket and second bracket.

3. The bollard door support of claim 1, where the door is coupled to the first bracket and second bracket with fasteners.

4. The bollard door support of claim 1, where the first bracket and second bracket is integrated inside of the door.

5. The bollard door support of claim 1, where the lower bearing forms a hole that the bollard is able to fit through.

6. The bollard door support of claim 1, where the upper bearing forms a hole that the bollard is able to fit through.

7. The bollard door support of claim 2, where the top bearing is smaller than a hole formed by the lower bearing.

8. The bollard door support of claim 6, where the top bearing is smaller than the hole formed by the upper bearing.

* * * * *